US006059709A

United States Patent [19]

Achelpohl et al.

[11] Patent Number: 6,059,709

[45] Date of Patent: May 9, 2000

[54] PROCESS FOR PRODUCING BAGS WITH FOLDED OVER AND SECURED HANDLES BY A FOLD-OVER ROD EXTENDING AT A RIGHT ANGLE TO THE DIRECTION OF TRANSPORT

[75] Inventors: Fritz Achelpohl, Lienen; Wilfried Lotz, Lengerich, both of Germany

[73] Assignee: Windmöller & Hölscher, Lengerich/Westf., Germany

[21] Appl. No.: 09/010,584

[22] Filed: Jan. 22, 1998

[30] Foreign Application Priority Data

Jan. 22, 1997 [DE] Germany ..... 197 02 144

[51] Int. Cl.[7] ..... B31B 1/86

[52] U.S. Cl. ..... 493/226; 493/926

[58] Field of Search ..... 493/221, 226, 493/926

[56] References Cited

U.S. PATENT DOCUMENTS

| | | | |
|---|---|---|---|
| 3,034,409 | 5/1962 | Finke et al. | 493/226 |
| 3,054,442 | 9/1962 | Atwood et al. | 493/226 |
| 3,590,696 | 7/1971 | Reissner et al. | 493/226 |
| 3,613,523 | 10/1971 | Wesselmann | 493/221 |
| 3,722,377 | 3/1973 | Hayes | 493/226 |
| 3,818,810 | 6/1974 | Bosse | 493/221 |
| 3,827,928 | 8/1974 | Van De Gent | 493/226 |
| 3,835,756 | 9/1974 | Bosse | 493/221 |
| 5,437,594 | 8/1995 | Mattson et al. | 493/226 |
| 5,609,556 | 3/1997 | Rostalski et al. | 493/226 |
| 5,800,326 | 9/1998 | Meynard et al. | 493/221 |
| 5,816,993 | 10/1998 | Fowler et al. | 493/226 |

FOREIGN PATENT DOCUMENTS

| | | |
|---|---|---|
| 195 12 719 | 11/1995 | Germany . |
| 678730 | 9/1952 | United Kingdom . |

*Primary Examiner*—Stephen F. Gerrity
*Attorney, Agent, or Firm*—Jacobson, Price, Holman & Stern, PLLC

[57] ABSTRACT

The handles of bags, provided with legs, are cemented to both sides of the opening sides of the bags. The handles are U-shaped handles made of strip-shaped material. Parts of the handles are folded over onto the side walls of the bags and fastened with adhesive spots to the side walls of the bags or to the non-folded over segments of the legs. After the legs have been glued to the continuously conveyed bags, the handle parts are folded over onto the side walls of the bags around prerupture lines of the legs in the direction of transport. The handle parts are folded over by at least one fold-over rod extending at a right angle to the direction of transport.

10 Claims, 1 Drawing Sheet

PROCESS FOR PRODUCING BAGS WITH FOLDED OVER AND SECURED HANDLES BY A FOLD-OVER ROD EXTENDING AT A RIGHT ANGLE TO THE DIRECTION OF TRANSPORT

FIELD OF THE INVENTION

The invention relates to a process for producing bags having handles. The handles include legs which are cemented to both sides of the opening of the bags. The handles are U-shaped, made of a strip-shaped material, and whose handle parts are folded over onto the side walls of the bags. The handles are fastened by adhesive spots on the side walls of the bags or on the non-folded over segments of the legs. The invention also relates to a device for carrying out this process.

BACKGROUND OF THE INVENTION

To stack flawlessly flat bags with handles, it is customary to fold over the handle parts, which project beyond the opening edges of the bags, onto the side walls of the bags, so that no parts of the handles protrude beyond the opening edges of the bags. Those parts of the handle that were folded back so as to lie flat on the bag do not interfere with the stacking of the bags. This is because the bags are usually provided with bottoms that are folded into the plane of the bag so that the multilayered floor region is compensated for by the layers of handles. Thus an essentially flat stack of bags can be produced.

German reference DE 195 12 719 A1 discloses a process of the type described, where handles are cemented on the bags. The handles are folded in such a manner that their portions, which project beyond the opening edge of the bag, are folded over onto the leg segments of the handles that are intended for cementing and are affixed to the bag with adhesive spots.

To produce bags according to the existing process, however, relatively complicated device is required. To cement the handles on continuously conveyed bags, a handle affixing drum is required. A fold-over rod, which can be moved, for example, parallel to the drum's circumference, and whose circumferential velocity is greater than that of the handle affixing drum, grasps the segments of the handle used for attachment and folds them over toward a front bend line. Then the attachment segments, which are folded over toward the front of the bag by 180 degrees, are cemented on the continuously conveyed bag in a cementing section. The fold-over rod retracts just before reaching the cementing section. The handles are prevented from springing up by previously fastening the attachment segments together with the handle by means of applied bonding spots. One drawback of the existing device is the fold-over rod, which swings back and forth and which prevents higher machine speeds since the fold-over rod reverses its direction.

SUMMARY OF THE INVENTION

Therefore, the object of the invention is to propose a process which can be carried out with less complicated devices and at a higher speed than has previously been done.

According to the invention, the problem associated with prior processes is solved in that adhesive spots are applied and, after the legs have been glued to the continuously conveyed bags, the handle parts are folded over onto the side walls of the bags, preferably around prerupture lines of the legs in the direction of transport.

The process, according to the invention, can be carried out on less complicated machines, because for the purpose of folding over the handles in the direction of transport there can be forward pointing fold-over rods, which revolve continuously at a higher speed than the speed of transport and which, for example are fastened to rotating levers or to continuously revolving belts or chains.

A device for carrying out the process of the invention includes a conveyor, which conveys continuously the bags provided with the glued-on handles, and at least one fold-over rod, which is fastened to continuous belts or chains or to rotating levers and revolves at a higher speed at right angles to the direction of transport. The fold-over rod grasps the handles from the bottom and folds the handles over onto those areas of the side walls of the bags that are provided with bonding spots and pushes the handles against said regions. Another embodiment of the invention envisions that there are adhesive nozzles applying the bonding spots so that the fold-over rods fold over the handles, which are glued to both sides of the opening edges of the bags, and apply the adhesive spots. The adhesive spots comprise a hot adhesive, so that, as soon as the spots are applied, the handles are affixed in their folded over position in the direction of transport.

The bags with the folded over handles can be readily stacked and packaged in the desired manner. For the purpose of usage, the handles can be readily detached again from the adhesive spots, serving only the purpose of fastening.

BRIEF DESCRIPTION OF THE DRAWINGS

One embodiment of the invention is explained in detail in the following with the aid of the drawings.

DETAILED DESCRIPTION OF THE PREFERRED EMBODIMENTS

Figure 1:
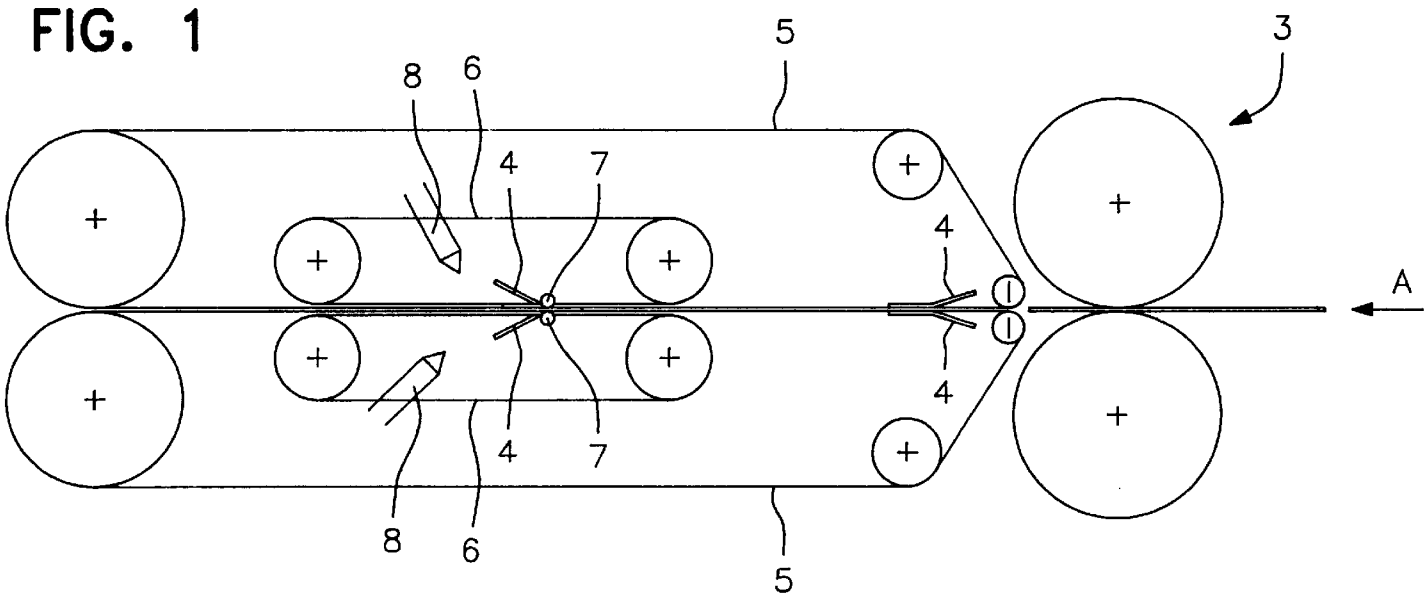
FIG. 1 is a schematic presentation of a side view of the device for producing handle bags with the handles folded over onto the bags.
Figure 2:
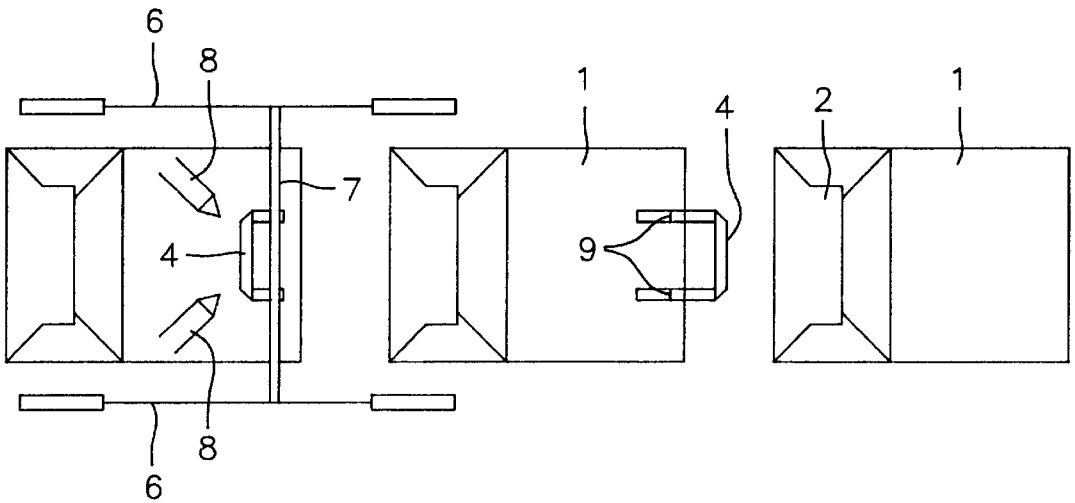
FIG. 2 is a top view of the device according to FIG. 1, depicting the individual production steps.

The flat lying bags 1 with bottoms 2, folded into the plane of the bags, are conveyed in succession continuously in the direction of the arrow A. The bags run with their bottoms leading into the handle station 3, where handles 4, folded in the shape of a U in the customary manner from segments made of strip-shaped material, are cemented in the manner depicted to both sides of the opening edges of the bags 1. The devices for folding the handles 4 in the shape of a U and for cementing said handles to the opening edges of bags 1 are well-known and shall, therefore, not be described here in detail.

Then the bags 1, with the bottoms 2 leading and the handles following and projecting beyond the opening edges of the bag, enter into the double belt conveyor 5, which together with belts that engage with the sides of the bags 1 takes over the further transport.

In the central region of the double belt conveyor there are deflecting rods 7, which are fastened to continuous belts or chains 6 below and above the plane of transport and which revolve at a higher speed than the transport speed of the double belt conveyor 5. The rods grasp the handles 4 from the bottom and fold them over towards the front in the direction of transport and level them out. The frame has adhesive nozzles 8, which eject, in cycles, the hot adhesive spots onto the sides walls of the bags. The hot adhesive spots are applied in such a manner with positional accuracy that the fold-over rods 7 smooth out the handles on said spots, so that they are fastened to the side walls of the bags and cannot spring up again.

To ensure that the handles 4 enter into the fold-over station in a slightly opened state, as illustrated, they are provided beforehand with prerupture lines 9, which cause the desired springing up and form the fold lines.

We claim:

1. Process for producing bags, said process comprising:

moving the bags in a direction of transport at a predetermined transport speed, cementing two U-shaped handles, provided with legs, and made of strip-shaped material to two opposite sides of the bags, folding over parts of the handles onto the sides of the bags, fastening the folded over parts of the handles with adhesive spots to the sides of the bags or to the non-folded over segments of the handles, the parts of the handle folded over onto the sides of the bags are folded along prerupture lines of the legs of the handles in the direction of transport of the bags, wherein the bags provided with the handles encounter at least one fold-over rod moving at a higher speed than the predetermined transport speed of the bags and extending at a right angle to the direction of transport of the bags, grasps the handles and folds the handles over onto areas of the sides of the bags provided with adhesive spots and pushes the handles against said areas.

2. The process as claimed in claim 1, wherein adhesive nozzles apply the adhesive spots.

3. Process for producing bags with handles, said process comprising:

conveying bags in a conveyance direction at a predetermined speed, attaching U-shaped handles to the bags on opposite sides of the bags, and folding over a projecting portion of the handles on top of the sides of the bags by a fold-over rod extending at a right angle to the conveyance direction and moving at a greater speed than said predetermined speed.

4. Process for producing bags with handles as claimed in claim 3, wherein the handles are folded along prerupture lines.

5. Process for producing bags with handles as claimed in claim 3, wherein the bags are conveyed in a flat plane and the fold-over rod moves in a parallel plane to said flat plane.

6. Process for producing bags with handles as claimed in claim 3, wherein adhesive spots are applied to the bags to hold the folded over projecting portions of the handles.

7. Process for producing bags with handles as claimed in claim 6, wherein the adhesive spots are applied to the sides of the bags.

8. Process for producing bags with handles as claimed in claim 6, wherein the adhesive spots are applied to the handles.

9. Process for producing bags with handles as claimed in claim 3, wherein the fold-over rod is attached to continuous drives located on opposite sides of the conveyed bags.

10. Process for producing bags with handles as claimed in claim 3, wherein the fold-over rod is straight.

* * * * *